US006588653B1

(12) United States Patent
Schmidt

(10) Patent No.: US 6,588,653 B1
(45) Date of Patent: Jul. 8, 2003

(54) ENVELOPE PULL OPENER

(76) Inventor: Karl B. Schmidt, 2454 N. 96th St., Wauwalosa, WI (US) 53226

( * ) Notice: Subject to any disclaimer, the term of this patent is extended or adjusted under 35 U.S.C. 154(b) by 0 days.

(21) Appl. No.: 10/260,957

(22) Filed: Sep. 30, 2002

Related U.S. Application Data

(62) Division of application No. 09/668,986, filed on Sep. 26, 2000, now Pat. No. 6,457,638.

(51) Int. Cl.[7] ..... B65D 27/38
(52) U.S. Cl. ..... 229/310; 229/239; 229/311
(58) Field of Search ..... 229/311, 312, 229/310, 239; 383/206

(56) References Cited

U.S. PATENT DOCUMENTS

| | | | | | |
|---|---|---|---|---|---|
| 337,985 | A | * | 3/1886 | Paige | 229/312 |
| 1,085,632 | A | * | 2/1914 | Roy | 229/310 |
| 1,176,640 | A | | 3/1916 | Barber | |
| 1,934,098 | A | * | 11/1933 | Smith et al. | 229/311 |
| 2,573,610 | A | * | 10/1951 | Russo | 229/312 |
| 3,139,231 | A | * | 6/1964 | Hueschen | 206/459.5 |
| 3,653,585 | A | | 4/1972 | Kazaros | 229/85 |
| 3,655,120 | A | * | 4/1972 | Stern | 229/310 |
| 4,795,035 | A | * | 1/1989 | Kim | 229/310 |
| 5,505,376 | A | | 4/1996 | Kent et al. | 229/311 |
| 5,732,877 | A | | 3/1998 | Lee | 229/311 |
| 5,984,170 | A | * | 11/1999 | Scheuren | 229/310 |

* cited by examiner

*Primary Examiner*—Stephen P. Garbe
(74) *Attorney, Agent, or Firm*—Donald J. Ersler

(57) ABSTRACT

An envelope pull opener includes a pair of pull tabs and a tearing filament. A single pull tab is attached to each end of the tearing filament. A peel-off adhesive surface is applied to one side of the pull tab. Preferably, the other side of the pull tab is structured to have a logo, picture, or other graphical representation applied thereto. The pull tab is preferably round, but could be any other shape such as square or triangular. In a second embodiment, the pull tab opener has a single pull tab on each end and an anchor tab attached in substantially the middle of the tearing filament. A third embodiment includes, a rigid envelope pull opener includes a first arm, a second arm, a pivotal connector, and a pair of pull tabs. A single pull tab is attached to an end of each arm. The other end of each arm is pivotal constrained by the pivotal connector. In a fourth embodiment, a sliding envelope pull opener includes a single pull tab on each end of a stationary filament; one end of a sliding filament slidably retainer by the stationary filament; and a slide tab affixed to the other end of the sliding filament. In a fifth embodiment, a decorative pull tab is attached to a pull filament of an existing envelope or to the detachable portion of a perforated envelope. In a sixth embodiment, the pull tab is attached to a mini-letter opener. The mini-letter opener is used to open the envelope.

12 Claims, 9 Drawing Sheets

ENVELOPE PULL OPENER

CROSS-REFERENCES TO RELATED APPLICATIONS

This is a divisional application taking priority from Ser. No. 09/668,986 filed on Sep. 26, 2000, now U.S. Pat. No. 6,457,638.

BACKGROUND OF THE INVENTION

1. Field of the Invention

The present invention relates generally to envelopes and more specifically to an envelope pull opener which may be sold separately from an envelope or included as part of an envelope.

2. Discussion of the Prior Art

There are numerous patents which disclose envelopes which are designed to reduce the amount of effort required to open an envelope. Some of these patents include U.S. Pat. No. 1,176,640 to Barber, U.S. Pat. No. 3,653,585 to Kazaros, U.S. Pat. No. 5,505,376 to Kent et al., and U.S. Pat. No. 5,732,877 to Lee. None of these patents disclose offering envelope pull openers in bulk and applying the envelope pull openers to the envelopes of the user's choice. Further, the above patents disclose a substantial length of tearing wire, string, strip or other tearing filament which must be adhered to the envelope. Adhering a substantial length of the tearing filament to an envelope makes user installation of a envelope pull opener more difficult.

Finally, none disclose the utilization of the various opener elements for decorative, promotional or advertising purposes.

Accordingly, there is a clearly felt need in the art for an envelope pull opener which may be sold separately and attached to an envelope of the user's choice; an envelope pull opener which increases the probability that an envelope will be opened by a recipient; an envelope pull opener which makes it enjoyable to open an envelope; and an envelope pull opener which does not require a substantial length of the tearing filament to be adhered to the envelope. And an envelope pull opener in which the appropriate elements of the opening structures may be deployed to provide additional visual stimulation for decorative or promotional purposes.

SUMMARY OF THE INVENTION

The present invention provides an envelope pull opener which may be attached to an envelope of a user's choice or included as an integral portion thereof. The envelope pull opener includes a pair of generally flat pull tabs and a tearing filament. A single pull tab is attached to each end of the tearing filament. A peel-off laminate label, covering an adhesive surface is formed on one side of the pull tab. Preferably, the other side of the pull tab is structured to have a logo, picture, or other graphical representation applied thereto. The pull tab is preferably round, but could be any other shape such as square or triangular, or, in fact, have any geometry whose borders circumscribes any object, word, picture or logo the sender may be interested in presenting.

In a second embodiment, the pull tab opener has a single pull tab on each end and an anchor tab attached somewhere along the length of the envelope fold, preferably at substantially the middle of the tearing filament. The anchor tab has an adhesive surface on a back thereof similar to the pull tab. In a third embodiment, a rigid envelope pull opener includes a first arm, a second arm, a pivotal connector, and a pair of pull tabs. A single pull tab is attached to an end of the first arm and to an end of the second arm.

In a fourth embodiment, a sliding envelope pull opener includes a single pull tab on each end of a stationary filament, a sliding filament, and a slide tab affixed to one end of the sliding filament. The other end of the sliding filament slides relative to the length of the stationary filament. In a fifth embodiment, a decorative pull tab is attached to a pull filament of an existing envelope or to the detachable portion of a perforated envelope. In a sixth embodiment, the pull tab is attached to a mini-letter opener.

The envelope pull opener is preferably installed in an envelope in the following manner. The material to be mailed is inserted into the envelope. The adhesive portion of the closure flap is wetted or the laminate label peeled-off. The tearing filament is placed in the fold between a closure flap and a front panel of an envelope. The pair of pull tabs are outside the envelope. The closure flap is folded over and sealed against a back panel of the envelope. The laminate label is peeled off the back of each pull tab, exposing adhesive material, and the pull tabs are pressed on to the closure flap or back panel of the envelope.

A first alternative of the envelope pull opener places one of the pull tabs inside the envelope. A second alternative of the envelope pull opener provides attaching one of the pull tabs to an inside of the envelope. The other pull tab is placed on a back or front of the envelope. A side of the envelope may be opened with the tearing filament.

A third alternative of the envelope pull opener is forming a slit in the envelope. One of the pull tabs is attached to the inside of the envelope at a bottom end. The other pull tab is inserted through the slit and attached to the back or front panel of the envelope. A fourth alternative of the envelope pull opener is attaching one of the pull tabs to the back of the front panel or closure flap. The other pull tab is attached to the back panel of the envelope.

In the second embodiment, the anchor tab is pressed on to the a back of the front panel or closure flap. Each end of the tearing filament is placed in the fold at each end of the envelope. In the third embodiment, the pivotal connector is attached to the back of the front panel or closure flap. The ends of the first and second arms are placed in the fold at each end of the envelope. The closure flap is sealed and the pull tabs attached to the front or back of the envelope.

In the fourth embodiment, one pull tab is attached to one top end of the front panel and the other pull tab is attached to the other end top end of the front panel. The sliding tab is preferably attached to the back panel at a center thereof. The sliding tab is slide in one direction and then the other to separate the closure flap seal. In the fifth embodiment, the pull tab acts as an attractive decoration and also provides extra leverage to pull the pull filament or separate the detachable portion from an envelope. In the sixth embodiment, the pull tab is detached from the envelope. The pull tab is pulled until the mini-letter opener is removed. The mini-letter opener is used to open the envelope.

Accordingly, it is an object of the present invention to provide an envelope pull opener which may be sold separately and attached to an envelope of a user's choice.

It is a further object of the present invention to provide an envelope pull opener which does not require a substantial length of the tearing filament to be adhered to the envelope.

It is yet a further object of the present invention to provide an envelope pull opener which increases the probability that an envelope will be opened by a recipient.

It is yet a further object of the present invention to provide an envelope pull opener which makes it enjoyable to open an envelope.

Finally, it is another object of the present invention to provide for the utilization of the various opener elements for decorative, promotional or advertising purposes.

These and additional objects, advantages, features and benefits of the present invention will become apparent from the following specification.

DETAILED DESCRIPTION OF THE PREFERRED EMBODIMENTS

Figure 1:
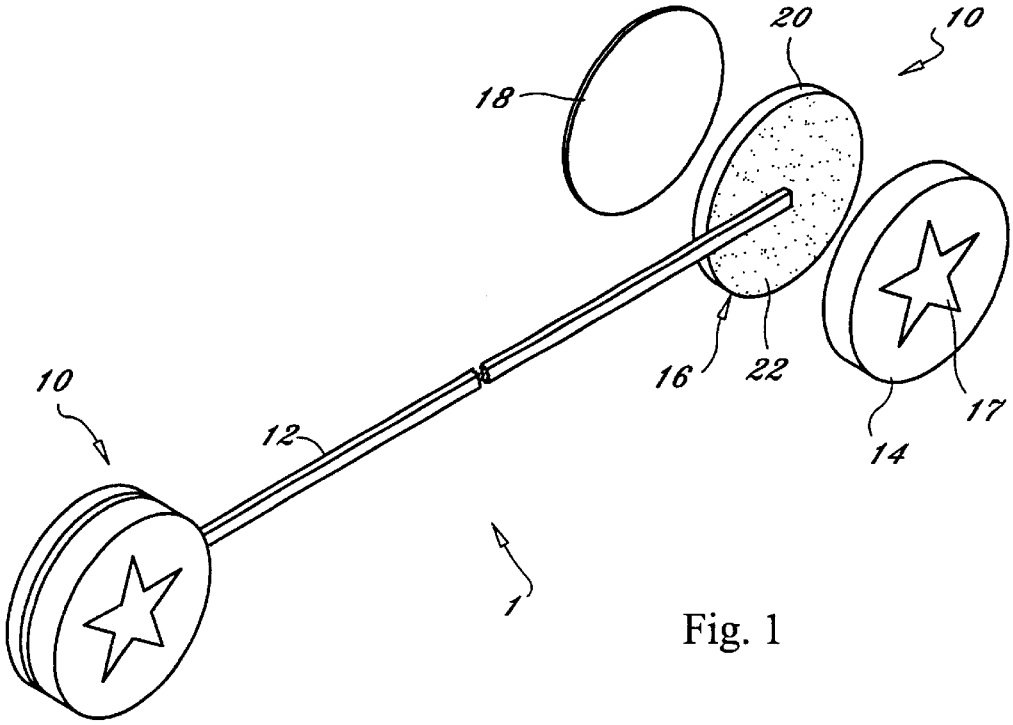
FIG. 1 is a partially exploded perspective view of an envelope pull opener in accordance with the present invention.
Figure 2:
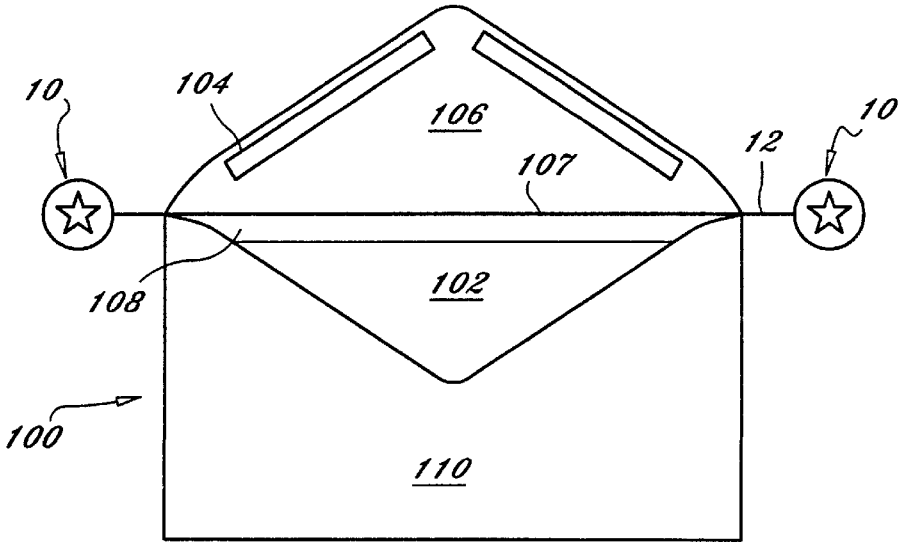
FIG. 2 is a rear view of an envelope with an envelope pull opener placed in the fold between the closure flap and front panel of the envelope in accordance with the present invention.
Figure 3:
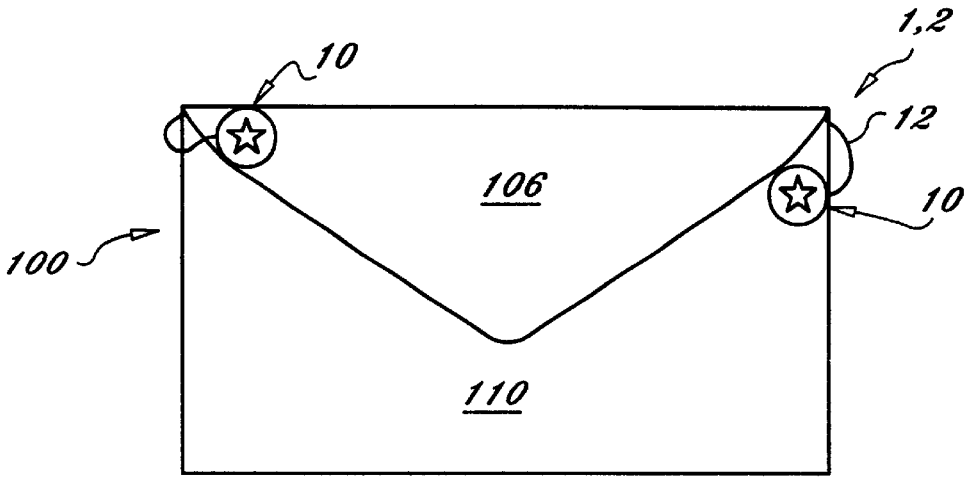
FIG. 3 is a rear view of an envelope with an envelope pull opener after the closure flap has been sealed in accordance with the present invention.
Figure 4:
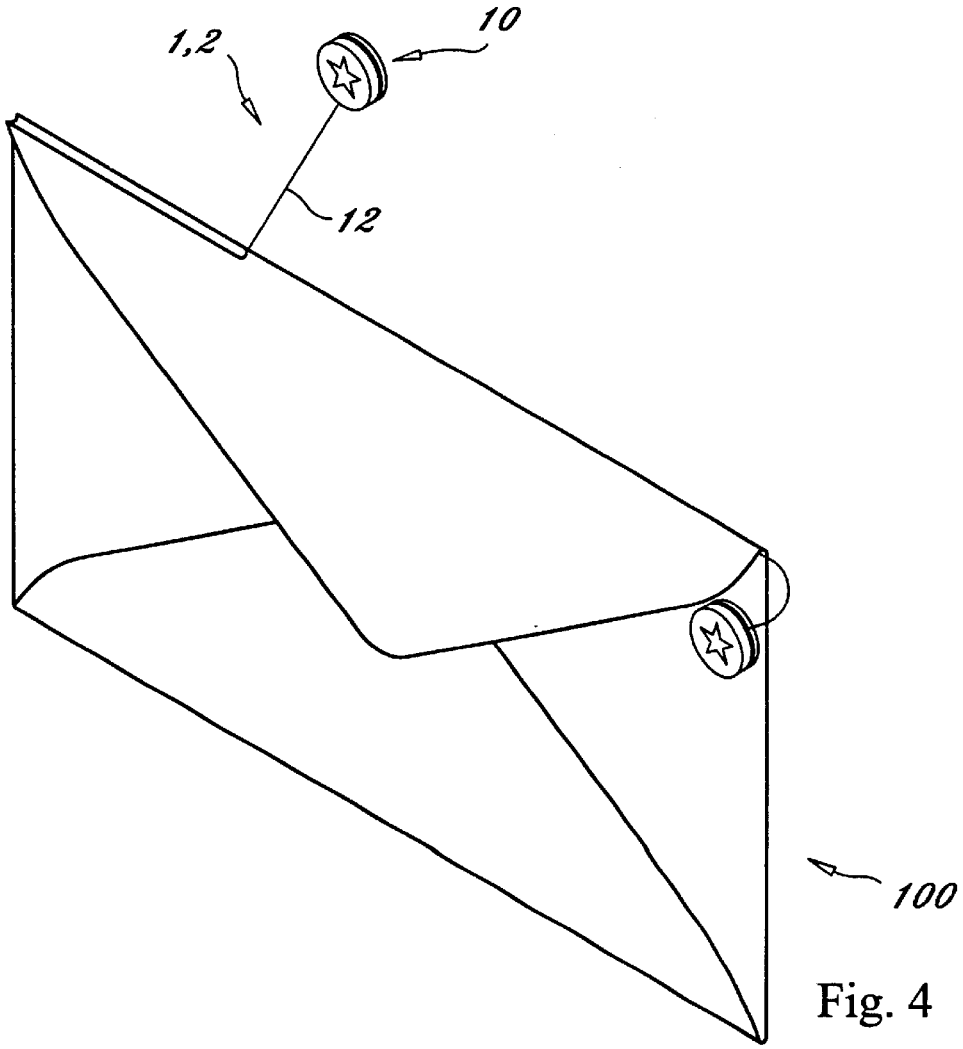
FIG. 4 is a front view of an envelope being ripped open with an envelope pull opener in accordance with the present invention.

With reference now to the drawings, and particularly to FIG. 1, there is shown a partial perspective view of an envelope pull opener 1. With reference to FIGS. 2–4, the envelope pull opener 1 includes a pair of pull tabs 10 and a tearing filament 12. The tearing filament 12 may be fabricated from wire, string, dental floss, or any other suitable material. The tearing filament 12 may also be fabricated from an elastic material. Each pull tab 10 includes a graphic pad 14, adhesive pad 16, and a peel-off laminate label 18. The pads are preferably round in shape, but may be any other geometric shape such as square or triangular. A logo, image, picture, or other graphic representation 17 is preferably printed on a front of the graphic pad 14. The pads may be large enough to write a return address thereupon.

A pressure sensitive adhesive 20 (not shown) is applied to a rear of the adhesive pad 16. The pressure sensitive adhesive 20 is preferably reusable such that the adhesive pad 16 may be attached to multiple surfaces. The peel-off laminate label 18 is applied to the pressure sensitive adhesive 20 to protect the rear of the adhesive pad 16 from premature adhesion. A fastening adhesive 22 is applied to a rear of the graphic pad 14 or a front of the adhesive pad 16 or both. At assembly, an end of the tearing filament 12 is sandwiched between the graphic pad 14 and the adhesive pad 16 after the fastening adhesive 22 is applied.

The envelope pull opener 1 is preferably installed in an envelope 100 in the following manner. The material 102 to be mailed is inserted into the envelope 100. The adhesive portion 104 of a closure flap 106 is wetted or the laminate label peeled-off. The tearing filament 12 is placed in the fold line 107 between the closure flap 106 and a front panel 108 of the envelope 100. The pull tabs 10 must be outside the envelope 100. The closure flap 106 is folded over and sealed against the back panel 110 of the envelope 100. The peel-off laminate label 18 is removed from the rear of each pull tab 10 and the pair of pull tabs 10 are pressed on to a front or back of the envelope 100. To open the envelope 100, one of the pull tabs 10 is removed and the user rips the fold line 107 with the tearing filament 12 until the material 102 may be removed from the envelope 100.

Figure 2A:
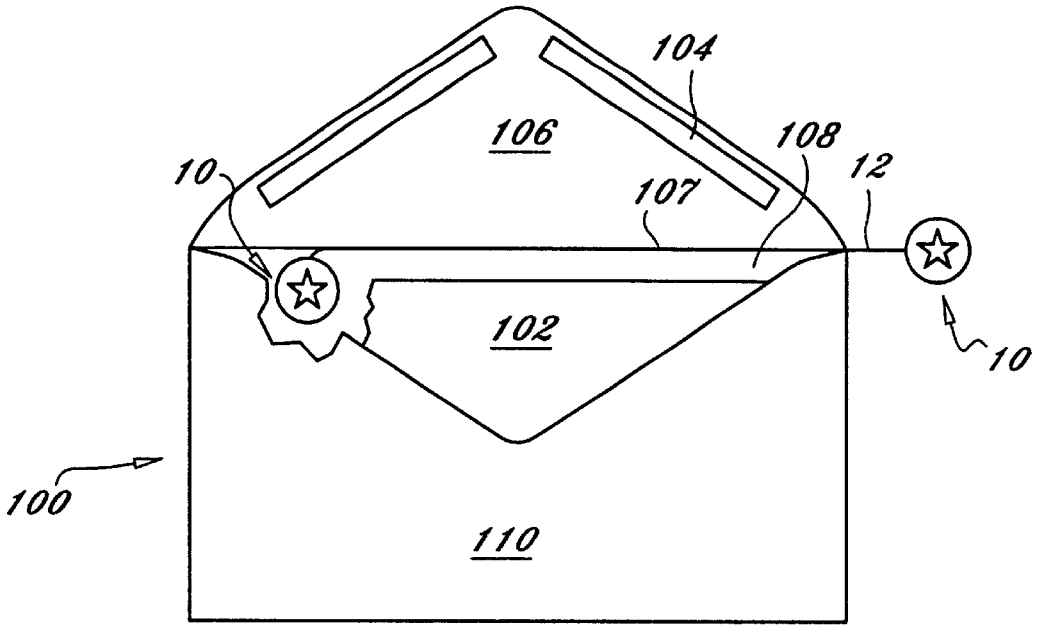
FIG. 2*a* is a rear view of a first alternative of an envelope with an envelope pull opener placed in the fold between the closure flap and front panel of the envelope with one of the pull tabs inside the envelope in accordance with the present invention.
Figure 2B:
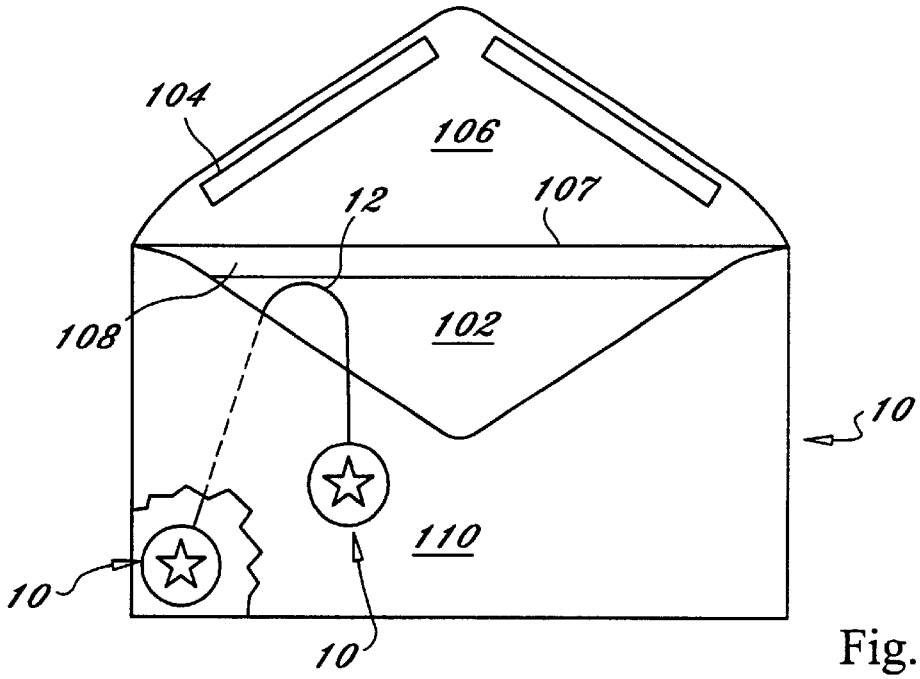
FIG. 2*b* is a rear view of a second alternative of an envelope with an envelope pull opener placed inside of the envelope in accordance with the present invention.

A first alternative of the envelope pull opener 1 is implemented by placing one pull tab 10 inside the envelope 100 and the other pull tab 10 outside the envelope 100 as shown in FIG. 2*a*. A second alternative of the envelope pull opener 1 is implemented by attaching one pull tab 10 inside the envelope 100 before insertion of material 102 and attaching the other pull tab 10 to the front or back of the envelope 100 after the insertion of material 102 as shown in FIG. 2*b*. The pull tab 10 on the outside of the envelope 100 is used to tear a side of the envelope 100 instead of the top.

Figure 2C:
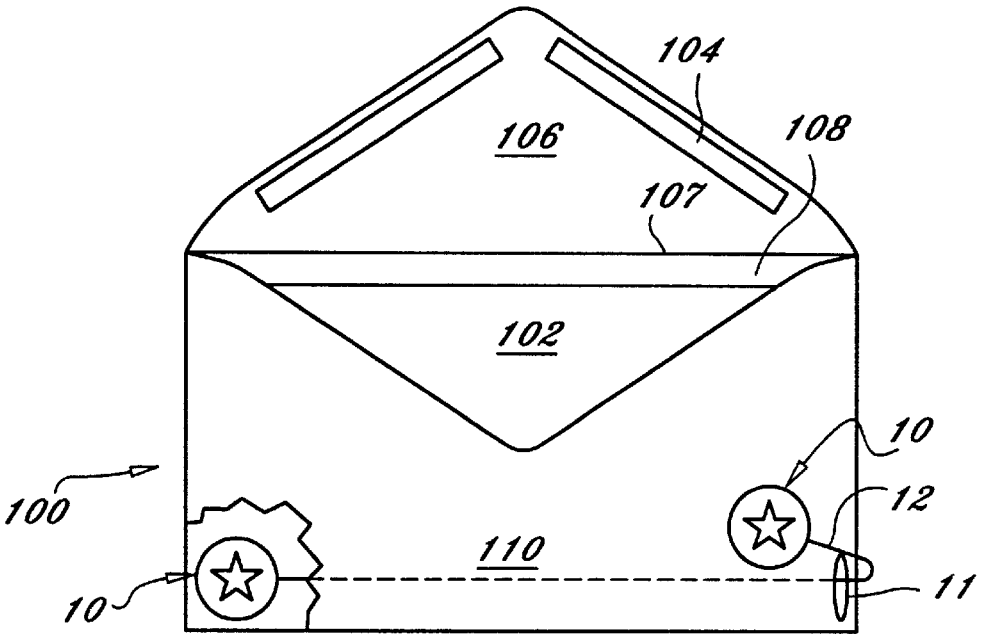
FIG. 2*c* is a rear view of a third alternative of an envelope with an envelope pull opener placed inside of the envelope with a slit formed in a bottom of the envelope for inserting a pull tab in accordance with the present invention.

A third alternative of the envelope pull opener 1 is implemented by attaching one pull tab 10 inside the envelope 100 before insertion of material 102 and inserting the other pull tab 10 through a slit 112 and attaching the other pull tab to the back or front of the envelope 100 after the insertion of material 102 as shown in FIG. 2*c*. The slit 112 may be located either on the front or back of the envelope 100. The pull tab 10 on the outside of the envelope 100 is used to tear a bottom of the envelope 100 instead of the top or side.

Figure 2D:
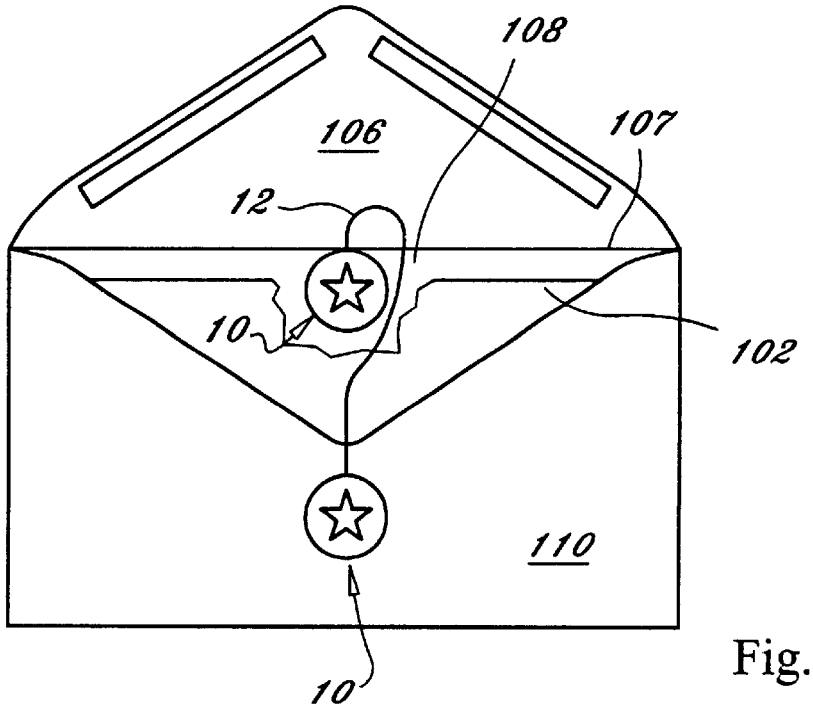
FIG. 2*d* is a rear view of a fourth alternative of an envelope with an envelope pull opener placed below the fold line, substantially in the middle of the envelope in accordance with the present invention.

A fourth alternative of the envelope pull opener 1 is implemented by attaching one pull tab 10 to a back side of the front panel 108, below the fold line 107 and before insertion of material 102. The one pull tab 10 may also be attached to a back of the closure flap 106, above the fold line 107. The other pull tab 10 is attached to the back panel 110 after insertion of material 102. The tearing filament 12 extending from the one pull tab 10 is preferably oriented to point at the closure flap 106 as shown in FIG. 2*d*. The other pull tab 10 is attached to the back panel 110. The closure flap 106 is sealed against the back panel 110. The other pull tab 10 on the outside of the envelope 100 is used to separate the seal between the closure flap 106 and the back panel 110.

Figure 5:
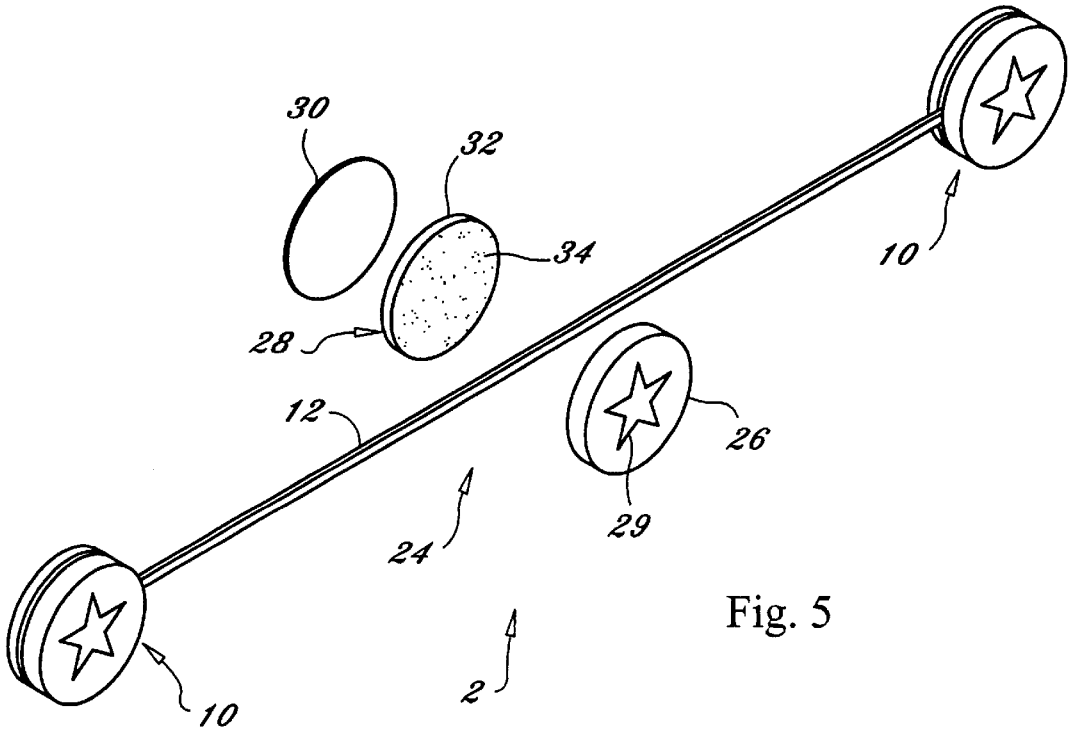
FIG. 5 is a partially exploded perspective view of a second embodiment of an envelope pull opener in accordance with the present invention.

With reference to FIG. 5, a second embodiment of the envelope pull opener 2 has a pull tab 10 on each end and an anchor tab 24 attached in substantially the middle of the tearing filament 12. The anchor tab 24 includes a graphic pad 26, an adhesive pad 28, and a peel-off laminate label 30. A logo, image, picture, or other graphic representation 29 is preferably printed on a front of the graphic pad 26. A pressure sensitive adhesive 32 (not shown) is applied to a rear of the adhesive pad 28. The pressure sensitive adhesive 32 is preferably reusable. The peel-off label 30 is applied to the pressure sensitive adhesive 32 to protect the rear of the adhesive pad 28 from premature adhesion. A fastening adhesive 34 is applied to a rear of the graphic pad 26 or a front of the adhesive pad 28 or both. At assembly, an end of the tearing filament 12 is sandwiched between the graphic pad 26 and the adhesive pad 28 after the fastening adhesive 34 is applied.

Figure 6:
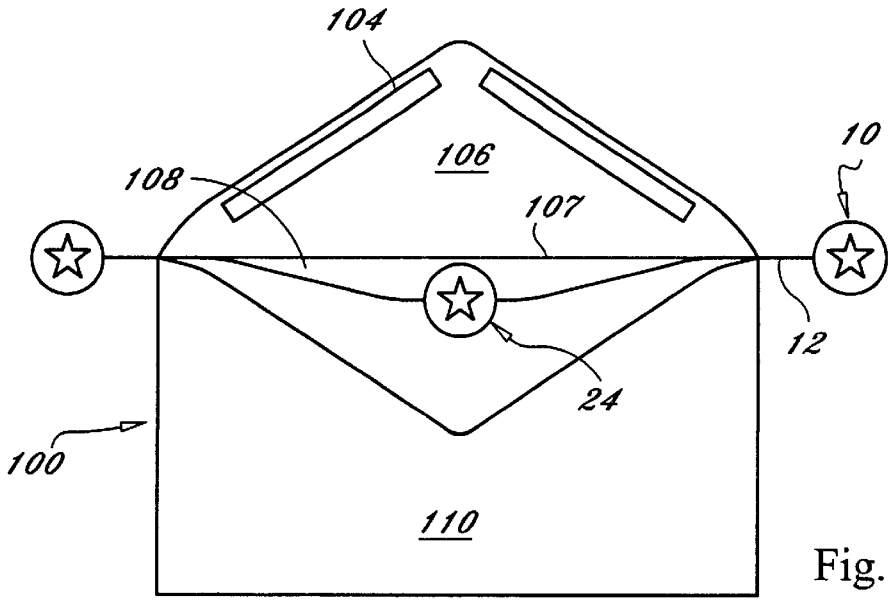
FIG. 6 is a rear view of an envelope with a second embodiment of an envelope pull opener placed in the fold between the closure flap and front panel of the envelope in accordance with the present invention.

With reference to FIG. 6, the envelope pull opener 2 is preferably installed in the envelope 100 in the following manner. The peel-off laminate label 30 is removed from the rear of the anchor tab 24. A top of the anchor tab 24 is pressed on to the front panel 108, just below the fold line 107. The anchor tab 24 may also be pressed on to a back of the closure flap 106, above the fold line 107. The material 102 to be mailed is then inserted into the envelope 100. The adhesive portion 104 of the closure flap 106 is wetted or the laminate label peeled-off. Each end of the tearing filament 12 is placed in the fold line 107 at each end of the envelope 100. The pull tabs 10 must be outside the envelope 100. The closure flap 106 is folded over and sealed against the back panel 110 of the envelope 100. The peel-off laminate label 18 is removed from the rear of each of the pull tabs 10 and the pair of pull tabs 10 are pressed on to the front or back of the envelope 100. With reference to FIG. 4, the envelope 100 is opened by removing one of the pull tabs 10 and ripping the fold line 107 with the tearing filament 12 until the material 102 may be removed from the envelope 100.

Figure 7:
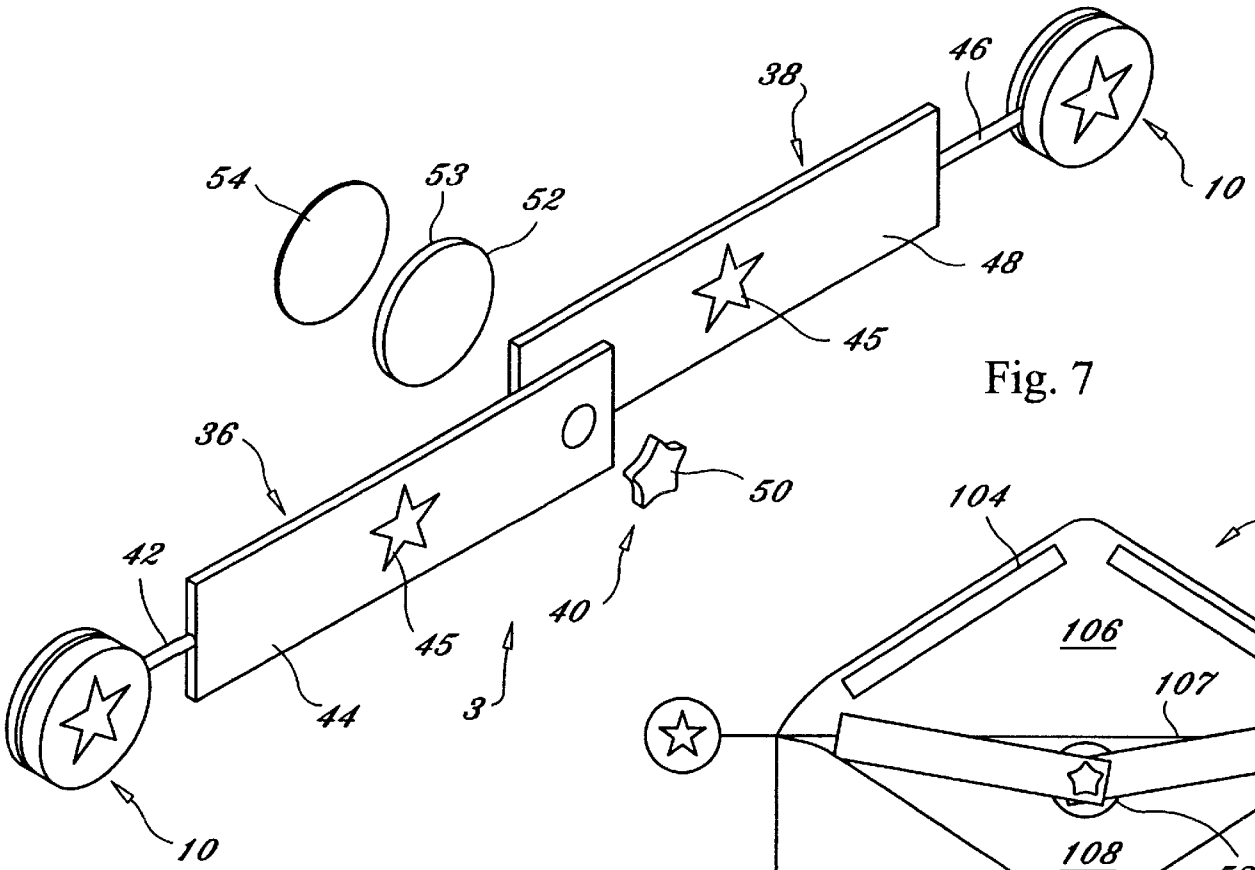
FIG. 7 is a partially exploded perspective view of a rigid envelope pull opener in accordance with the present invention.

With reference to FIG. 7, a rigid envelope pull opener 3 includes a first arm 36, a second arm 38, a pivotal connector 40, and a pair of pull tabs 10. The first arm 36 includes a first filament 42 formed on one end and a first rigid body 44 formed on the other end thereof. A first hole is formed through the other end of the first arm 36. The second arm 38 includes a second filament 46 formed on one end and a second rigid body 48 formed on the other end thereof. A second hole is formed through the other end of the second arm 36. The first filament 42 and the second rigid body 44 are preferably a single piece of material, but could be separate pieces attached to each other. The second filament 46 and the second rigid body 48 are preferably a single piece of material, but could be separate pieces which are attached to each other. A top edge of the first and second rigid bodies may be serrated to improve cutting of the envelope 100. The first and second filaments may be elastic. A logo, image, picture, or other graphic representation 45 may be printed on at least one side of the first and second arms.

The pivotal connector 40 includes a retainer 50, a base 52, and a peel-off laminate label 54. The retainer 50 is attached to a top of the base 52 with sonic welding, heat sealing, adhesive, or any other suitable process. The retainer 50 is preferably attached to the base 52 with the first and second arms between the retainer and the base 52. A pressure sensitive adhesive 53 (not shown) is applied to a rear of the base 52. The pressure sensitive adhesive 53 is preferably reusable such that the adhesive pad 16 may be attached to multiple surfaces. The peel-off laminate label 54 is applied to the pressure sensitive adhesive 53 to protect the rear of the base 52 from premature adhesion. The retainer 50 is sized to fit through the holes in the arms, yet retain thereof together in a pivotal relationship. A first pull tab 10 is attached to an end of the first filament 42 and a second pull tab 10 is attached to an end of the second filament 46.

Figure 8:
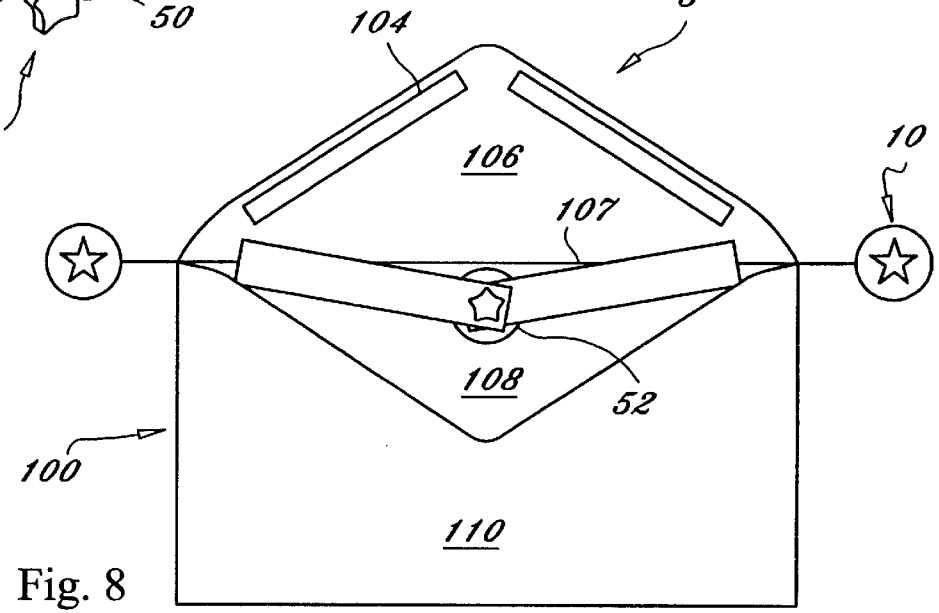
FIG. 8 is a rear view of an envelope with a rigid envelope pull opener placed in the fold between the closure flap and front panel of the envelope in accordance with the present invention.

With reference to FIG. 8, the rigid envelope pull opener 3 is preferably installed in an envelope 100 in the following manner. The rigid envelope pull opener 3 is centered in the envelope. The peel-off label 54 is removed from a back of the base 52. The base 52 is attached to a back of the front panel 108 below the fold line 107. The base 52 may also be attached to a back of the closure flap 106 above the fold line 107. The material to be mailed is then inserted into the envelope 100. The adhesive portion 104 of the closure flap is wetted or the laminate label peeled-off. The pair of pull tabs 10 must be outside the envelope. The closure flap 106 is folded over and sealed against the back panel 110 of the envelope 100. The peel-off laminate label 18 is peeled off the back of each pull tab 10 and the pull tabs 10 are pressed on to the front or back of the envelope 100.

Figure 9:
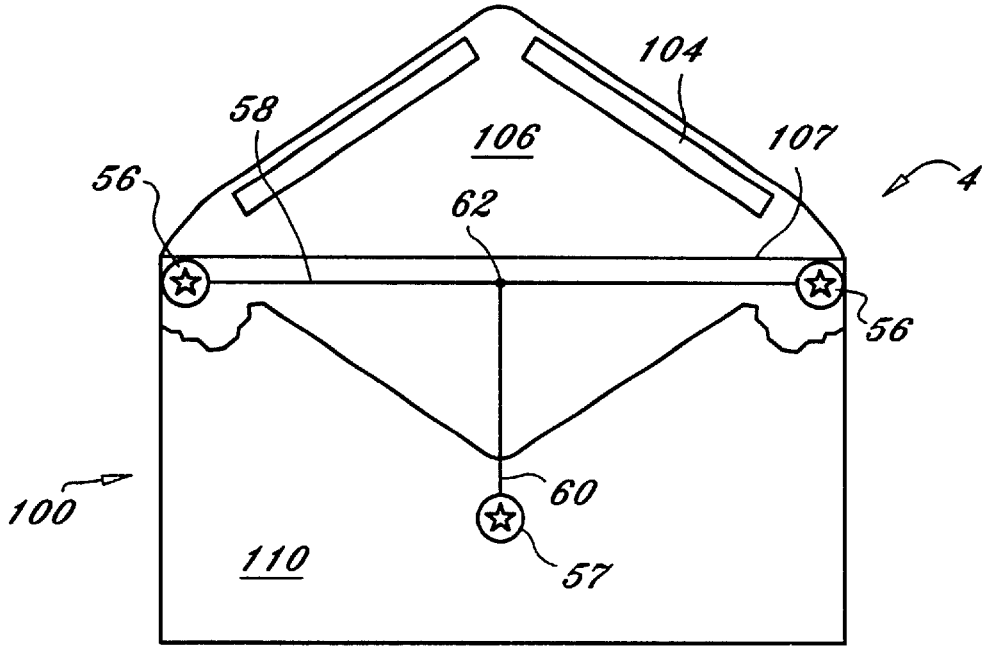
FIG. 9 is a rear view of a fourth embodiment of an envelope with an envelope pull opener with a sliding filament in accordance with the present invention.

With reference to FIG. 9, a fourth embodiment of the sliding envelope pull opener 4 includes a single anchor tab 56 attached to each end of a stationary filament 58 and a sliding filament 60. A loop 62 is formed on one end of the sliding filament 60 and a sliding tab 57 is attached to the other end thereof. The stationary filament 58 is inserted through the loop 62 before attachment of the anchor tabs 56. The loop 62 may be formed by creating a loop out of the sliding filament 60 itself or attaching the sliding filament to a separate structure. The anchor tabs 56 and sliding tab 57 are identical to the pull tab 10. The sliding filament 60 may be fabricated from an elastic material.

Each anchor tab 56 is pressed on to a back of the front panel 108, just below the fold line 107. The material to be mailed is then inserted into the envelope 100. The sliding tab 57 may be attached to any part of the back panel 110. The adhesive portion 104 of the closure flap 106 is wetted or the laminate label peeled-off and the closure flap 106 is then sealed against the back panel 110. The envelope 100 is opened by removing the sliding tab 57 and pull the sliding tab 57 back and forth until the seal between the closure flap 106 and the back panel 110 is broken.

Figure 10:
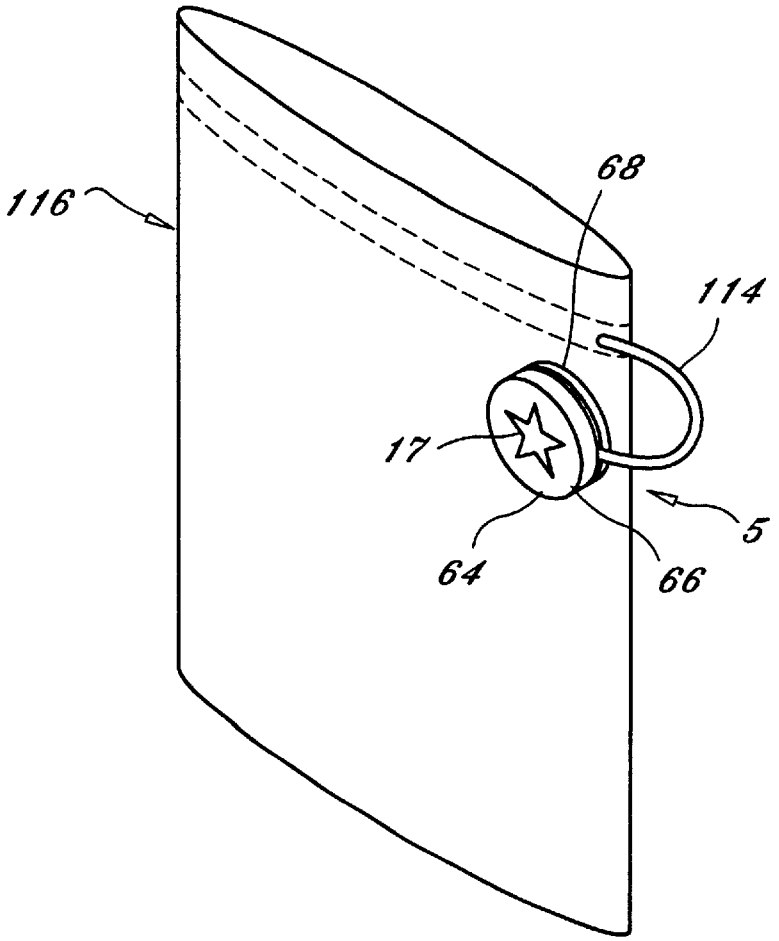
FIG. 10 is a perspective view of a decorative pull tab attached to an end of a pull filament of an easy opening envelope in accordance with the present invention.
Figure 11:
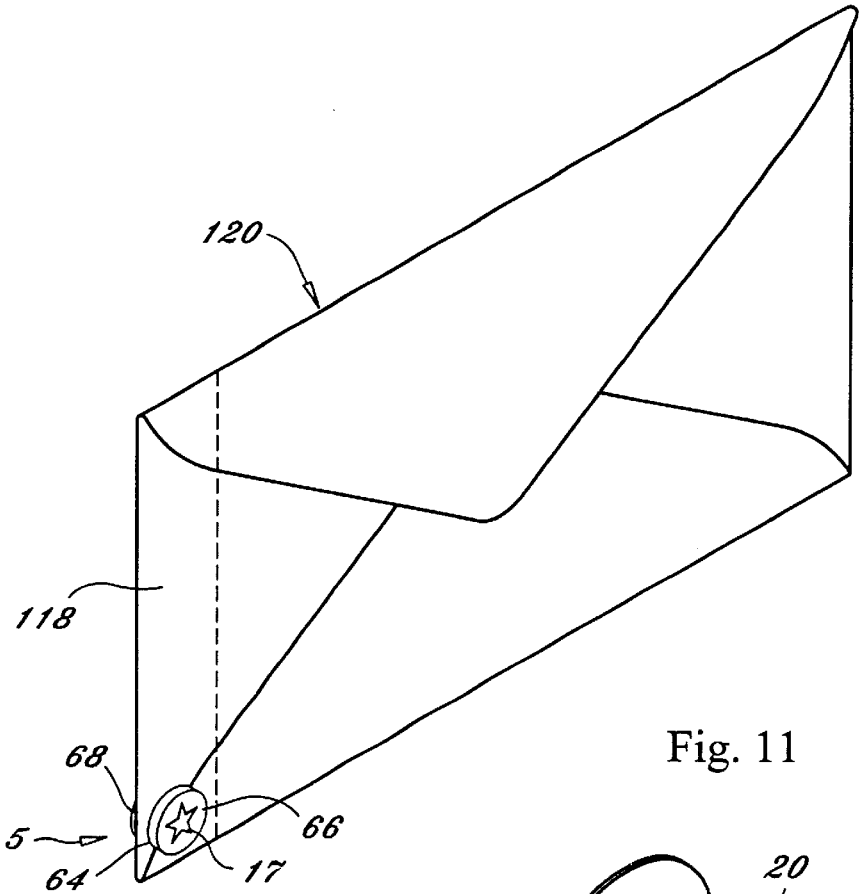
FIG. 11 is a perspective view of a decorative pull tab attached to a detachable portion of an easy opening envelope in accordance with the present invention.

With reference to FIGS. 10 and 11, a fifth embodiment of the envelope pull opener 5 includes a pull tab 64 attached to a pull filament 114 of an existing easy open envelope 116 or the pull tab 64 attached to a detachable portion 118 of an easy open envelope 120. The pull tab 64 includes a first graphic pad 66 and a second graphic pad 68. A logo, image, picture, or other graphic representation 17 is printed one side of the first and second graphic pads. The other side of the first and second graphic pads are attached to each other and to the pull filament 114 in FIG. 10 with adhesive or any other suitable assembly process. The other side of the first and second graphic pads are attached to each other and to the detachable portion 118 in FIG. 11 with adhesive or any other suitable assembly process. The pull tab 64 acts as an attractive decoration and also provides extra leverage to pull the pull filament or separate the detachable portion from an easy open envelope.

Figure 12:
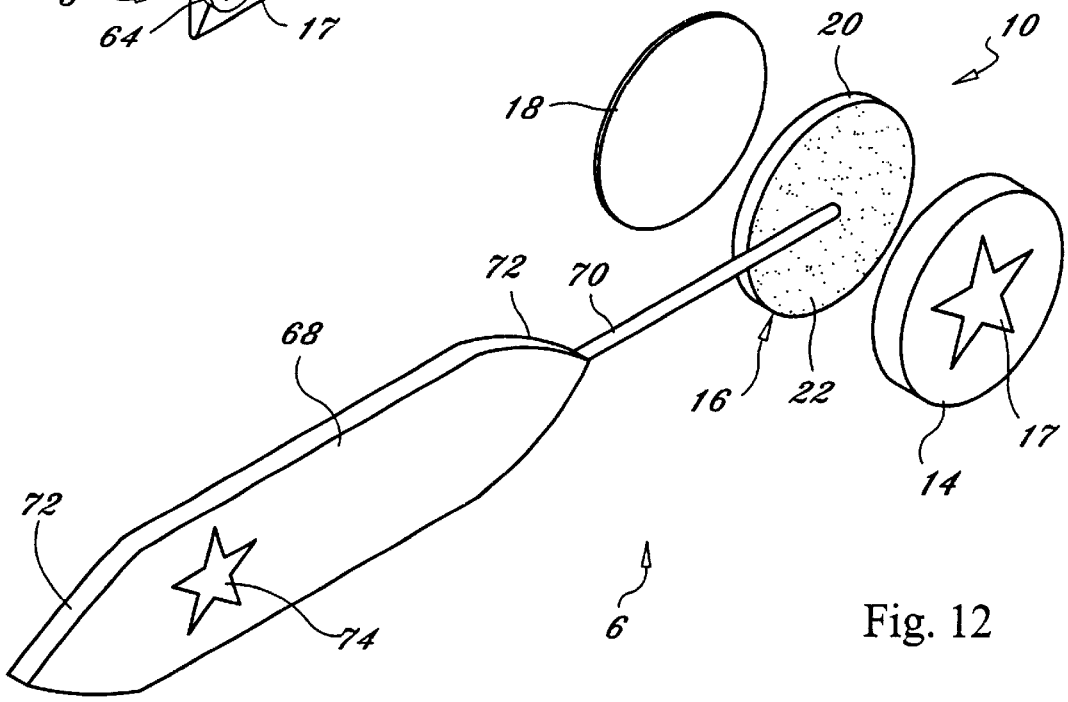
FIG. 12 is a perspective view of a fifth embodiment of an envelope pull opener with a mini-letter opener in accordance with the present invention.
Figure 13:
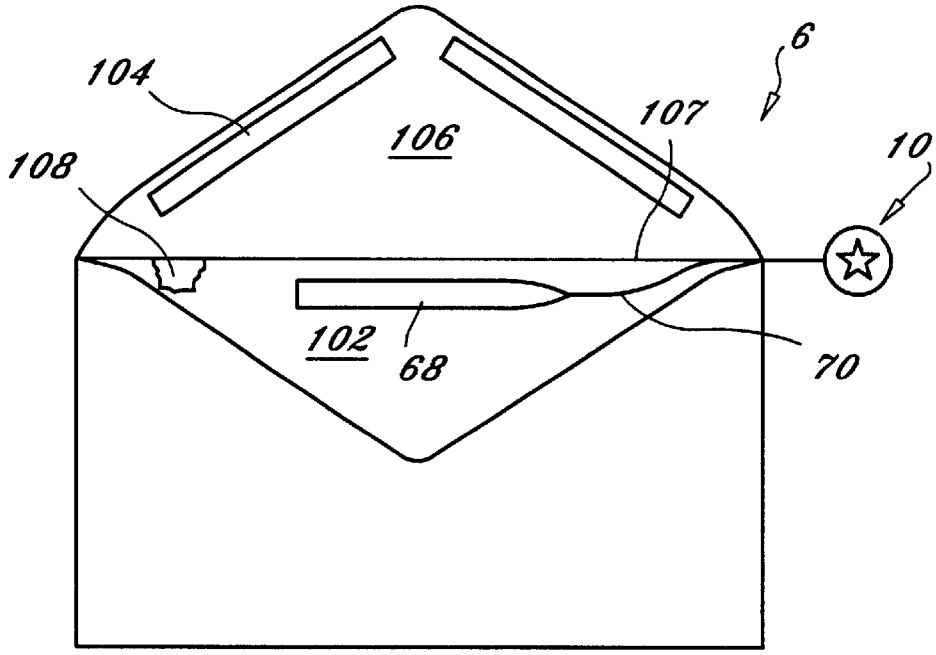
FIG. 13 is a rear view of a fifth embodiment of an envelope with an envelope pull opener with a mini-letter envelope opener in accordance with the present invention.

With reference to FIG. 12, a sixth embodiment of the envelope pull opener with a mini-letter opener 6 includes a mini-letter opener 68, a filament portion 70, and a pull tab 10. The miniletter opener 68 includes a flat lengthwise body with preferably a flat bullet nose 72 on each end thereof. A logo, image, picture, or other graphic representation 74 may be applied to one or both sides of the flat lengthwise body. One end of the filament portion 70 extends from the flat length wise body and the pull tab 10 extends from the other end thereof. The filament portion 70 may be fabricated from wire, string, dental floss, or any other suitable material. The pull tab 10 includes a graphic pad 14, an adhesive pad 16, and a peel-off laminate label 18. A fastening adhesive 22 is applied to a rear of the graphic pad 14 or a front of the adhesive pad 16 or both. At assembly, the filament portion 70 is sandwiched between the graphic pad 14 and the adhesive pad 16 after the fastening adhesive 22 is applied.

The material 102 to be mailed is inserted into the envelope 100. The mini-letter opener 68 may be placed on either side of the material 102. The pull tab 10 is located outside the envelope. The adhesive portion 104 of the closure flap 106 is wetted or the laminate label peeled-off and the closure flap 106 is then sealed against the back panel 110. The envelope 100 is opened by removing the sliding tab 10 and pull the pull tab 10 away from the envelope until the mini-letter opener 68 comes out. The mini-letter opener 68 is reinserted into the envelope 100 and used to tear a top, side, or bottom fold thereof.

Figure 14:
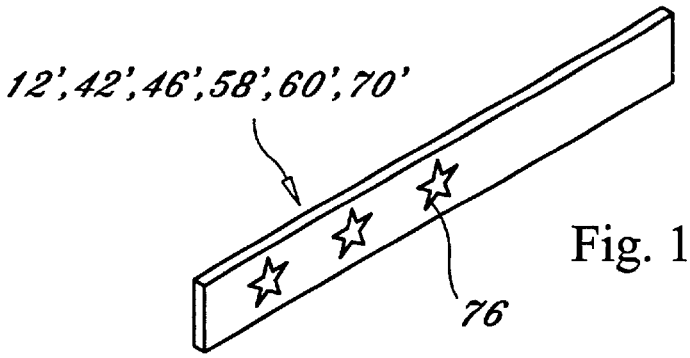
FIG. 14 is a perspective view of a filament which is wide enough to print a graphical image thereupon in accordance with the present invention.
Figure 15:
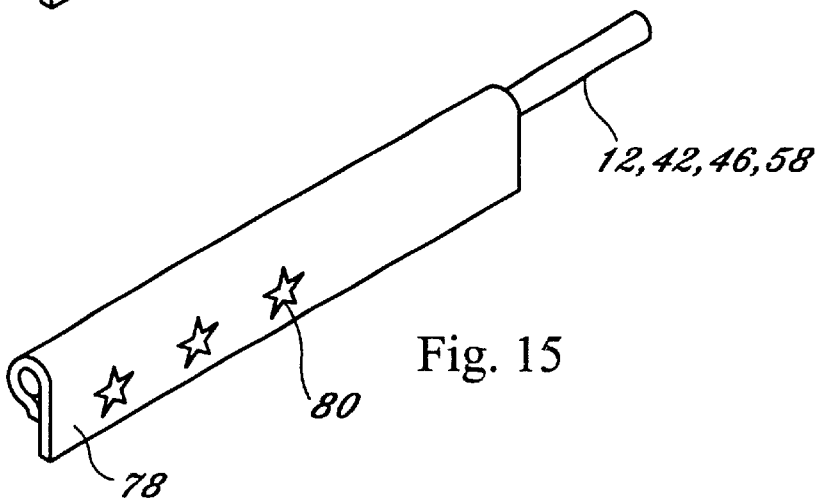
FIG. 15 is a perspective view of a banner attached to a filament in accordance with the present invention.

A wider filament 12', 42', 46', 58', 60' and 70' is disclosed in FIG. 14. The width of the tearing filament 12, the first filament 42, the stationary filament 58, the sliding filament 60, or the filament portion 70 may be increased to enable a logo, image, picture, or other graphic representation 76 to printed on the wider filament. A banner 78 is attached to the tearing filament 12, the first filament 42, or the stationary filament 58 in FIG. 15. A logo, image, picture, or other graphic representation 80 is printed on the banner 78.

The envelope pull openers 1–6 may be sold by themselves, sold with an envelope, or sold already attached to the envelope. If the envelope pull opener 1 is sold with an envelope; the envelope pull opener 1 may be attached to the envelope with a small amount of glue at each corner of the envelope. If the envelope pull opener with a mini-letter opener 6 is sold with an envelope; the filament portion 70 may be attached to the envelope with a small amount of glue at one corner of the envelope.

Instructions and/or illustrations may be printed on an envelope or attached to an envelope with a decal. The instructions and/or illustrations may instruct a user or recipient how to attach any envelope pull opener or remove thereof. The instructions and/or illustrations may also tell the user or recipient that the envelope pull opener may be reused.

An audio device may be activated by the pulling, pivoting, or movement of the pull tab when it is used to open an envelope. Preferably, the audio device is activated by the movement of any of the previously disclosed filaments. The audio device is commonly used in greeting cards. Nearly any audio message may be recorded on the audio device.

It is psychologically satisfying to rip open an envelope with one of the envelope pull openers as it is to pop open bubbles on bubble packing. Providing envelopes which open easy will increase the probability that a mailing will be opened. Having people open envelopes will increase the chance that an advertiser's literature will be read by recipient.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A rigid envelope pull opener comprising:

a first arm with a first filament extending from one end and a hole formed in the other end thereof;

a second arm with a second filament extending from one end and a hole formed in the other end thereof;

a first pull tab being attached to an end of said first filament;

a second pull tab being attached to an end of said second filament, wherein a graphic image being applied to a front of each said tab, a pressure sensitive adhesive being applied to a rear of each said tab, a peel-off label being applied to said pressure sensitive adhesive; and a pivotal connector having a retainer, a base, and a peel-off label, an adhesive surface being applied to a rear of said base, said peel-off label being applied to said adhesive surface, said first and second arms being placed between said retainer and said base, said retainer being attached to said base such that said first and second arms pivot relative to said pivotal connector.

2. The rigid envelope pull opener of claim 1, further comprising:

each said pull tab including a graphic pad and an adhesive pad, a fastening adhesive being applied to a rear of said graphic pad or to a front of said adhesive pad or to both, a single said end of said tearing filament being sandwiched between said graphic and adhesive pads.

3. The rigid envelope pull opener of claim 1, further comprising:

said pressure sensitive adhesive being a reusable adhesive such that said pull tab may be reattached to other surfaces.

4. The rigid envelope pull opener of claim 1, further comprising:

an envelope; and said base being attached to one of a back of a front panel of said envelope below a fold line and a back of a closure flap of said envelope above a fold line, said pair of pull tabs being located outside of said envelope, said closure flap being sealed against a back panel of said envelope, said tabs being affixed to a front or back of said envelope.

5. The rigid envelope pull opener of claim 1, further comprising:

a graphic image being applied to at least one side of said first and second arms.

6. A rigid envelope pull opener comprising:

a first arm with a first filament extending from one end and a hole formed in the other end thereof;

a second arm with a second filament extending from one end and a hole formed in the other end thereof;

an envelope having a closure flap and a front panel;

a first pull tab being attached to an end of said first filament;

a second pull tab being attached to an end of said second filament, wherein a graphic image being applied to a front of each said tab, a pressure sensitive adhesive being applied to a rear of each said tab, a peel-off label being applied to said pressure sensitive adhesive; and a pivotal connector having a retainer, a base, and a peel-off label, an adhesive surface being applied to a rear of said base, said peel-off label being applied to said adhesive surface, said first and second arms being placed between said retainer and said base, said retainer being attached to said base such that said first and second arms pivot relative to said pivotal connector, wherein said base being attached to one of a back of a front panel of said envelope below a fold line and a back of a closure flap of said envelope above a fold line, said pair of pull tabs being located outside of said envelope, said closure flap being sealed against a back panel of said envelope, said tabs being affixed to a front or back of said envelope.

7. The rigid envelope pull opener of claim 6, further comprising:

each said pull tab including a graphic pad and an adhesive pad, a fastening adhesive being applied to a rear of said graphic pad or to a front of said adhesive pad or to both, a single said end of said tearing filament being sandwiched between said graphic and adhesive pads.

8. The rigid envelope pull opener of claim 6, further comprising:

said pressure sensitive adhesive being a reusable adhesive such that said pull tab may be reattached to other surfaces.

9. The rigid envelope pull opener of claim 6, further comprising:

a graphic image being applied to at least one side of said first and second arms.

10. A method of reducing the amount of effort required to open an envelope comprising the steps of:

(a) providing an envelope with a front panel;

(b) providing a first arm with a first filament extending from one end and a hole formed in the other end thereof;

(c) providing a second arm with a second filament extending from one end and a hole formed in the other end thereof;

(d) attaching a single pull tab to each said filament;

(e) providing a pivotal connector having a retainer and a base;

(f) attaching said base to one of a back of a front panel of said envelope below a fold line and a back of a closure flap of said envelope above a fold line, said holes of first and second arms being retained behind said retainer such that they pivotal relative to said base;

(g) applying a graphic image to a front of each said pull tab;

(h) sealing said closure flap against a back panel of said envelope; and (i) affixing said pull tabs to a front or back of said envelope.

11. The method of reducing the amount of effort required to open an envelope of claim 10, wherein:

said pull tabs capable of being attached to more than one envelope.

12. The method of reducing the amount of effort required to open an envelope of claim 10, wherein:

a graphic image being applied to at least one side of said first and second arms.

* * * * *